US009132936B2

(12) United States Patent
Kohler

(10) Patent No.: US 9,132,936 B2
(45) Date of Patent: Sep. 15, 2015

(54) CARTON WITH TRAY

(71) Applicant: Graphic Packaging International, Inc., Atlanta, GA (US)

(72) Inventor: Karl A. Kohler, Bartlett, IL (US)

(73) Assignee: Graphic Packaging International, Inc., Atlanta, GA (US)

( * ) Notice: Subject to any disclaimer, the term of this patent is extended or adjusted under 35 U.S.C. 154(b) by 190 days.

(21) Appl. No.: 13/783,539

(22) Filed: Mar. 4, 2013

(65) Prior Publication Data

US 2013/0256392 A1 Oct. 3, 2013

Related U.S. Application Data

(60) Provisional application No. 61/686,046, filed on Mar. 29, 2012.

(51) Int. Cl.

| | |
|---|---|
| ***B65D 5/72*** | (2006.01) |
| ***B65D 71/36*** | (2006.01) |
| ***B31B 1/86*** | (2006.01) |
| ***B65B 5/02*** | (2006.01) |
| ***B65B 43/00*** | (2006.01) |

(52) U.S. Cl.

CPC ... *B65D 5/72* (2013.01); *B31B 1/86* (2013.01); *B65B 5/024* (2013.01); *B65B 43/00* (2013.01); *B65D 71/36* (2013.01); *B65D 2571/0066* (2013.01); *B65D 2571/00141* (2013.01); *B65D 2571/00401* (2013.01); *B65D 2571/00506* (2013.01); *B65D 2571/00567* (2013.01); *B65D 2571/00728* (2013.01)

(58) Field of Classification Search

USPC ..... 229/117.13, 117.16, 117.17, 120.32

See application file for complete search history.

(56) References Cited

U.S. PATENT DOCUMENTS

| | | | | |
|---|---|---|---|---|
| 1,120,752 | A | 12/1914 | Smiley | |
| 1,896,326 | A | 1/1933 | Northway-Ley | |
| 1,896,646 | A | 1/1933 | Taylor | |
| 2,312,846 | A | 3/1943 | Olvey | |
| 2,475,107 | A | 7/1949 | Newsom | |
| 2,758,774 | A * | 8/1956 | Grunert et al. | 229/117.07 |

(Continued)

FOREIGN PATENT DOCUMENTS

| | | |
|---|---|---|
| CH | 263456 | 8/1949 |
| DE | 88 14 144.6 | 1/1989 |

(Continued)

OTHER PUBLICATIONS

International Search Report and Written Opinion for PCT/US2013/028801 dated Jun. 14, 2013.

*Primary Examiner* — Gary Elkins

(74) *Attorney, Agent, or Firm* — Womble Carlyle Sandridge & Rice, LLP

(57) ABSTRACT

A carton for containing a plurality of articles arranged in at least a first layer and a second layer above the first layer. The carton comprises a plurality of panels that extends at least partially around an interior of the carton and an opening feature for accessing the articles in the carton. The opening feature extends in at least one panel of the plurality of panels. A tray is disposed at least partially in the interior of the carton. At least a portion of the tray can be positioned between the first layer and the second layer. The tray can be for supporting the articles in the second layer to allow removal of the articles in the second layer after activation of the opening feature of the carton.

48 Claims, 8 Drawing Sheets

(56) References Cited

U.S. PATENT DOCUMENTS

| | | | | | |
|---|---|---|---|---|---|
| 2,844,294 | A | | 7/1958 | Williams | |
| 2,875,942 | A | | 3/1959 | Wilson | |
| 2,989,221 | A | | 6/1961 | Butler | |
| 3,006,523 | A | * | 10/1961 | Keith | 229/120.37 |
| 3,101,880 | A | | 8/1963 | Peterson | |
| 3,158,312 | A | | 11/1964 | Simkins | |
| 3,664,494 | A | * | 5/1972 | Mergens | 206/45.22 |
| 3,732,976 | A | * | 5/1973 | Bessett et al. | 206/499 |
| 3,822,785 | A | | 7/1974 | Getz et al. | |
| 3,937,326 | A | | 2/1976 | Schick | |
| 4,105,154 | A | | 8/1978 | Meyers et al. | |
| 4,120,443 | A | | 10/1978 | Gardner et al. | |
| 4,138,052 | A | * | 2/1979 | Torigian | 229/120.32 |
| 4,421,229 | A | | 12/1983 | Pan et al. | |
| 4,530,459 | A | | 7/1985 | Maroszek | |
| 4,577,799 | A | | 3/1986 | Oliff | |
| 4,739,921 | A | | 4/1988 | Taub | |
| 4,811,837 | A | | 3/1989 | Larizza | |
| 4,919,269 | A | | 4/1990 | Wright | |
| 5,076,492 | A | | 12/1991 | Tupes | |
| 5,234,102 | A | | 8/1993 | Schuster et al. | |
| 5,246,113 | A | | 9/1993 | Schuster | |
| 5,316,210 | A | | 5/1994 | Scullin | |
| 5,415,344 | A | | 5/1995 | Harrelson | |
| 5,427,242 | A | | 6/1995 | Oliff et al. | |
| 5,437,143 | A | | 8/1995 | Culpepper et al. | |
| 5,518,111 | A | | 5/1996 | Stout | |
| 5,620,094 | A | | 4/1997 | Naumann | |
| 5,669,500 | A | | 9/1997 | Sutherland | |
| 5,682,984 | A | | 11/1997 | Howell et al. | |
| 5,699,957 | A | | 12/1997 | Blin et al. | |
| 5,772,030 | A | | 6/1998 | Baxter | |
| 5,813,540 | A | * | 9/1998 | Vollbrecht et al. | 206/497 |
| 5,826,783 | A | | 10/1998 | Stout | |
| 5,826,870 | A | | 10/1998 | Vulgamore et al. | |
| 5,848,686 | A | | 12/1998 | Dean | |
| 5,853,088 | A | * | 12/1998 | Saulas et al. | 206/427 |
| 5,868,252 | A | | 2/1999 | Oliff | |
| 5,938,109 | A | | 8/1999 | Sainz et al. | |
| 5,957,288 | A | | 9/1999 | Campbell | |
| 5,967,406 | A | | 10/1999 | Moorman | |
| 5,996,883 | A | | 12/1999 | Bates | |
| 6,012,630 | A | | 1/2000 | Block | |
| 6,112,977 | A | | 9/2000 | Sutherland et al. | |
| 6,176,419 | B1 | | 1/2001 | Holley, Jr. | |
| 6,244,502 | B1 | | 6/2001 | Hollar et al. | |
| 6,386,369 | B2 | | 5/2002 | Yuhas et al. | |
| 6,918,487 | B2 | | 7/2005 | Harrelson | |
| 6,991,107 | B2 | | 1/2006 | Harrelson | |
| 7,093,713 | B2 | | 8/2006 | Sutherland | |
| 7,168,558 | B2 | | 1/2007 | Harrelson | |
| 7,195,118 | B2 | | 3/2007 | Sutherland | |
| 7,270,259 | B2 | | 9/2007 | Sutherland | |
| 7,475,778 | B2 | | 1/2009 | Sutherland | |
| 7,578,427 | B2 | | 8/2009 | Durnin | |
| 7,717,321 | B2 | | 5/2010 | Spivey, Sr. et al. | |
| 7,793,821 | B2 | | 9/2010 | Oliveira | |
| 7,823,721 | B2 | * | 11/2010 | Sutherland et al. | 206/153 |
| 8,127,980 | B2 | | 3/2012 | Spivey, Sr. et al. | |
| 8,459,535 | B2 | | 6/2013 | Brand | |
| 2004/0245327 | A1 | | 12/2004 | Oliff et al. | |
| 2005/0023331 | A1 | * | 2/2005 | Hirschey | 229/117.15 |
| 2005/0115843 | A1 | | 6/2005 | Harrelson | |
| 2005/0167290 | A1 | | 8/2005 | Sutherland | |
| 2005/0167292 | A1 | | 8/2005 | Sutherland | |
| 2005/0173269 | A1 | | 8/2005 | Lebras | |
| 2006/0283926 | A1 | | 12/2006 | Drunin | |
| 2007/0170232 | A1 | * | 7/2007 | Spivey | 229/117.16 |
| 2011/0132978 | A1 | * | 6/2011 | de Sousa | 229/117.13 |

FOREIGN PATENT DOCUMENTS

| | | | | |
|---|---|---|---|---|
| DE | 91 11 941.3 | | 2/1992 | |
| EP | 0 595 602 | | 5/1994 | |
| FR | 1427897 | | 4/1966 | |
| FR | 1489087 | | 7/1967 | |
| FR | 1497652 | | 10/1967 | |
| FR | 2223985 | | 10/1974 | |
| FR | 2626256 | A1 * | 7/1989 | 206/427 |
| GB | 434145 | | 8/1935 | |
| GB | 2 198 709 | | 6/1988 | |
| GB | 2 323 352 | | 9/1998 | |
| JP | 62-062617 | | 10/1985 | |
| JP | 62-130024 | | 8/1987 | |
| JP | 1-73121 | | 5/1989 | |
| JP | 5-7621 | | 2/1993 | |
| JP | 7 125745 | | 5/1995 | |
| JP | 9 142449 | | 6/1997 | |
| JP | 11-130049 | | 5/1999 | |
| JP | 2000-85754 | | 3/2000 | |
| JP | 2000-238779 | | 9/2000 | |
| JP | 2002-526346 | | 8/2002 | |
| WO | WO 92/07772 | | 5/1992 | |
| WO | WO 96/29261 | | 9/1996 | |
| WO | WO 00/20288 | | 4/2000 | |
| WO | WO 01/30659 | | 5/2001 | |
| WO | WO 02/30764 | | 4/2002 | |
| WO | WO 2004/014755 | | 2/2004 | |

* cited by examiner

CARTON WITH TRAY

CROSS-REFERENCE TO RELATED APPLICATIONS

This application claims the benefit of U.S. Provisional Patent Application No. 61/686,046, filed Mar. 29, 2012.

INCORPORATION BY REFERENCE

The disclosures of U.S. Provisional Patent Application No. 61/686,046, which was filed on Mar. 29, 2012, and U.S. Pat. No. 7,717,321, which was issued May 18, 2010, are incorporated by reference as if presented herein in their entirety, for all purposes.

BACKGROUND OF THE DISCLOSURE

The present disclosure generally relates to cartons for holding and dispensing containers or other types of articles. More specifically, the present disclosure relates to cartons with a tray to separate at least two layers of articles and to support the top layer of the articles.

SUMMARY OF THE DISCLOSURE

In general, one aspect of the disclosure is directed to a carton for containing a plurality of articles arranged in at least a first layer and a second layer above the first layer. The carton comprises a plurality of panels that extends at least partially around an interior of the carton and an opening feature for accessing the articles in the carton. The opening feature extends in at least one panel of the plurality of panels. A tray is disposed at least partially in the interior of the carton. At least a portion of the tray can be positioned between the first layer and the second layer. The tray can be for supporting the articles in the second layer to allow removal of the articles in the second layer after activation of the opening feature of the carton.

In another aspect, the disclosure is generally directed to, in combination, a carton blank and a tray blank for forming a carton for containing a plurality of articles arranged in at least a first layer and a second layer above the first layer. The carton blank comprises a plurality of panels for at least partially extending around an interior of the carton formed from the blank and an opening feature extending in at least one panel of the plurality of panels. The tray blank comprises at least a main panel for at least partially forming a tray disposed at least partially in the interior of the carton formed from the carton blank. At least a portion of the main panel is for being positioning between the first layer and the second layer. When the carton is formed, the tray is for supporting the articles in the second layer to allow removal of the articles in the second layer after activation of the opening feature of the carton formed from the carton blank.

In another aspect, the disclosure is generally directed to a method of forming a carton. The method comprises obtaining a carton blank and a tray blank. The carton blank comprises a plurality of panels and an opening feature extending in at least one panel of the plurality of panels, and the tray blank comprises at least a main panel. The method further comprises forming an interior of the carton at least partially defined by the plurality of panels, the forming the interior of the carton comprising forming an open-ended sleeve. The method also can comprise forming a tray from the tray blank and arranging a plurality of containers in at least a first layer and a second layer so that at least a portion of the main panel of the tray is disposed between the first layer and the second layer. The method further can comprise inserting the plurality of containers and the tray at least partially into the interior of the carton. The tray can support the articles in the second layer to allow removal of the articles in the second layer after activation of the opening feature of the carton.

In another aspect, the disclosure is generally directed to a method of opening a carton. The method comprises obtaining a carton comprising a plurality of panels that extends at least partially around an interior of the carton, an opening feature extending in at least one panel of the plurality of panels, and a tray disposed at least partially in the interior of the carton. The carton contains a plurality of articles arranged in at least a first layer and a second layer above the first layer, and at least a portion of the tray is disposed between the first layer and the second layer. The tray can at least partially contain the articles in the second layer. The method also can comprise at least partially opening the carton by actuating the opening feature to form an upper portion and a lower portion of the carton and at least partially removing the upper portion. The method further can comprise removing the tray and the second layer of articles from the lower portion of the carton.

In another aspect, the disclosure is generally directed to a method of forming a handle in a carton. The method comprises obtaining a carton comprising a plurality of panels that extends at least partially around an interior of the carton, an opening feature extending in at least one panel of the plurality of panels, and obtaining a tray disposed at least partially in the interior of the carton, the tray comprising a main panel and a handle foldably connected to the main panel. The carton can contain a plurality of articles arranged in at least a first layer and a second layer above the first layer, and at least a portion of the main panel can be disposed between the first layer and the second layer. The method further can comprise grasping the handle of the tray and folding the handle out from the interior of the carton.

In another aspect, the disclosure is generally directed to a package comprising a carton containing a plurality of articles arranged in at least a first layer and a second layer above the first layer. The carton comprises a plurality of panels that extends at least partially around an interior of the carton and an opening feature for accessing the articles in the carton. The opening feature can extend in at least one panel of the plurality of panels. The package further comprises a tray at least partially disposed in the carton. At least a portion of the tray is positioned between the first layer and the second layer. The tray can support the articles in the second layer when removing the articles in the second layer after activation of the opening feature of the carton.

In another aspect, the disclosure is generally directed to a tray for being at least partially positioned between at least a first layer of containers and a second layer of containers. The tray comprises a main panel and an end flap foldably connected to the main panel. The end flap comprises a first portion and a second portion foldably connected to the first portion. The tray can further comprise a handle comprising a first handle panel in the first portion of the end flap and a second handle panel in the second portion of the end flap. The first handle panel can be foldably connected to the second handle panel, and the second handle panel can at least partially overlap the first handle panel. The first handle panel is at least partially defined by a tear line extending in the first portion of the end flap.

Those skilled in the art will appreciate the above stated advantages and other advantages and benefits of various additional embodiments reading the following detailed description of the embodiments with reference to the below-listed drawing figures.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to cartons including packages including a carton housing a plurality of articles and a divider positioned between layers of the articles. Cartons of the present disclosure can contain articles that can be, for example, beverage or food containers. The articles can also include soup cans or other food or beverage containers such as, for example, bottles, cans, PET containers, or other containers. The articles can be made from materials suitable in composition for packaging the particular food or beverage item, and the materials include, but are not limited to, glass; aluminum and/or other metals; plastics such as PET, LDPE, LLDPE, HDPE, PP, PS, PVC, EVOH, and Nylon; paperboard, composite paperboard and plastic; and the like, or any combination thereof.

Cartons according to the present disclosure can accommodate articles of any shape. For the purpose of illustration and not for the purpose of limiting the scope of the disclosure, the following detailed description describes beverage containers (e.g., aluminum cans or glass bottles) as disposed within the carton embodiments. In this specification, the terms "inner," "outer," "lower," "bottom," "upper," and "top" indicate orientations determined in relation to fully erected and upright cartons.

Figure 1:
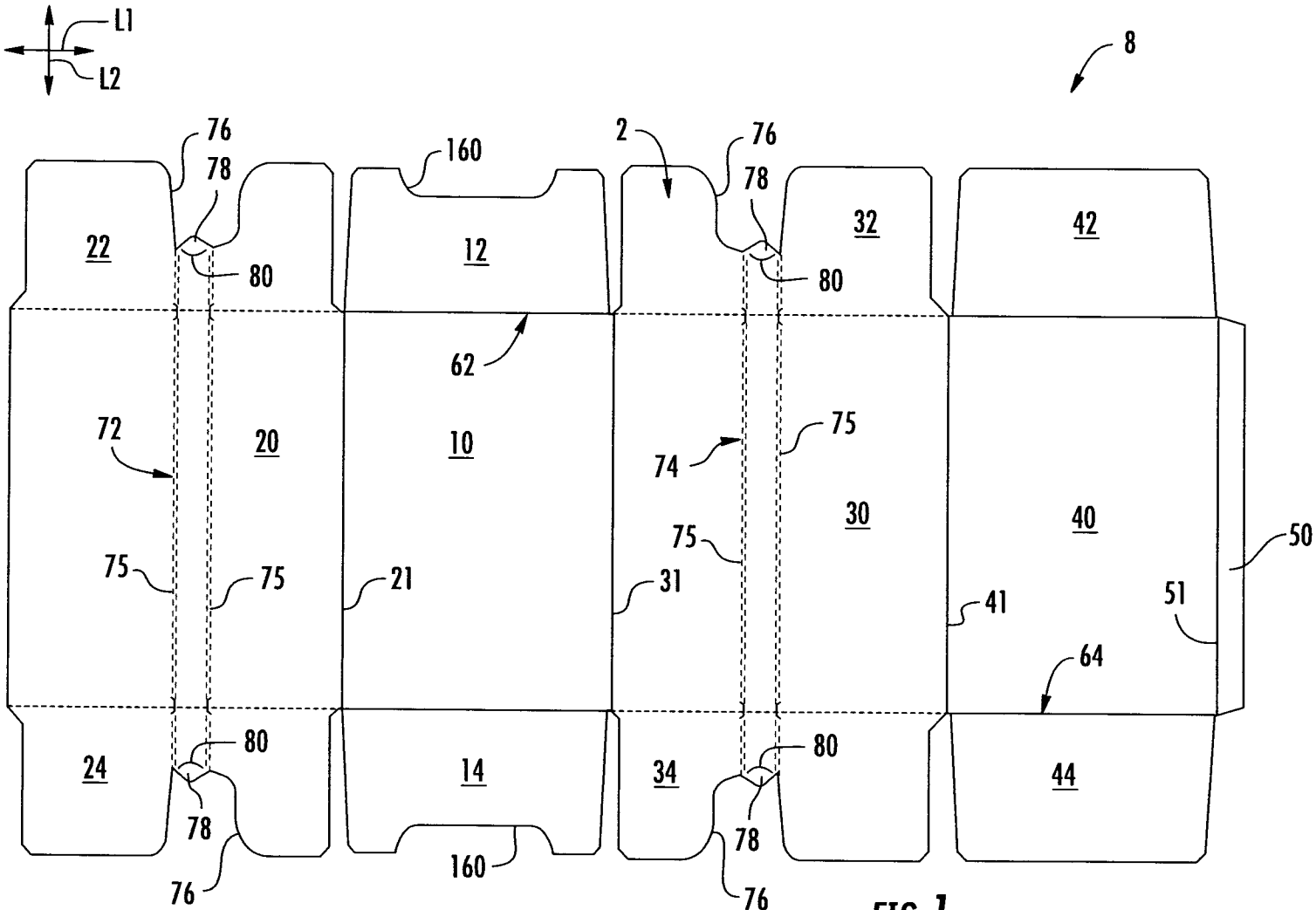
FIG. 1 is a plan view of a carton blank used to form a carton according to an exemplary embodiment of the disclosure.
Figure 2:
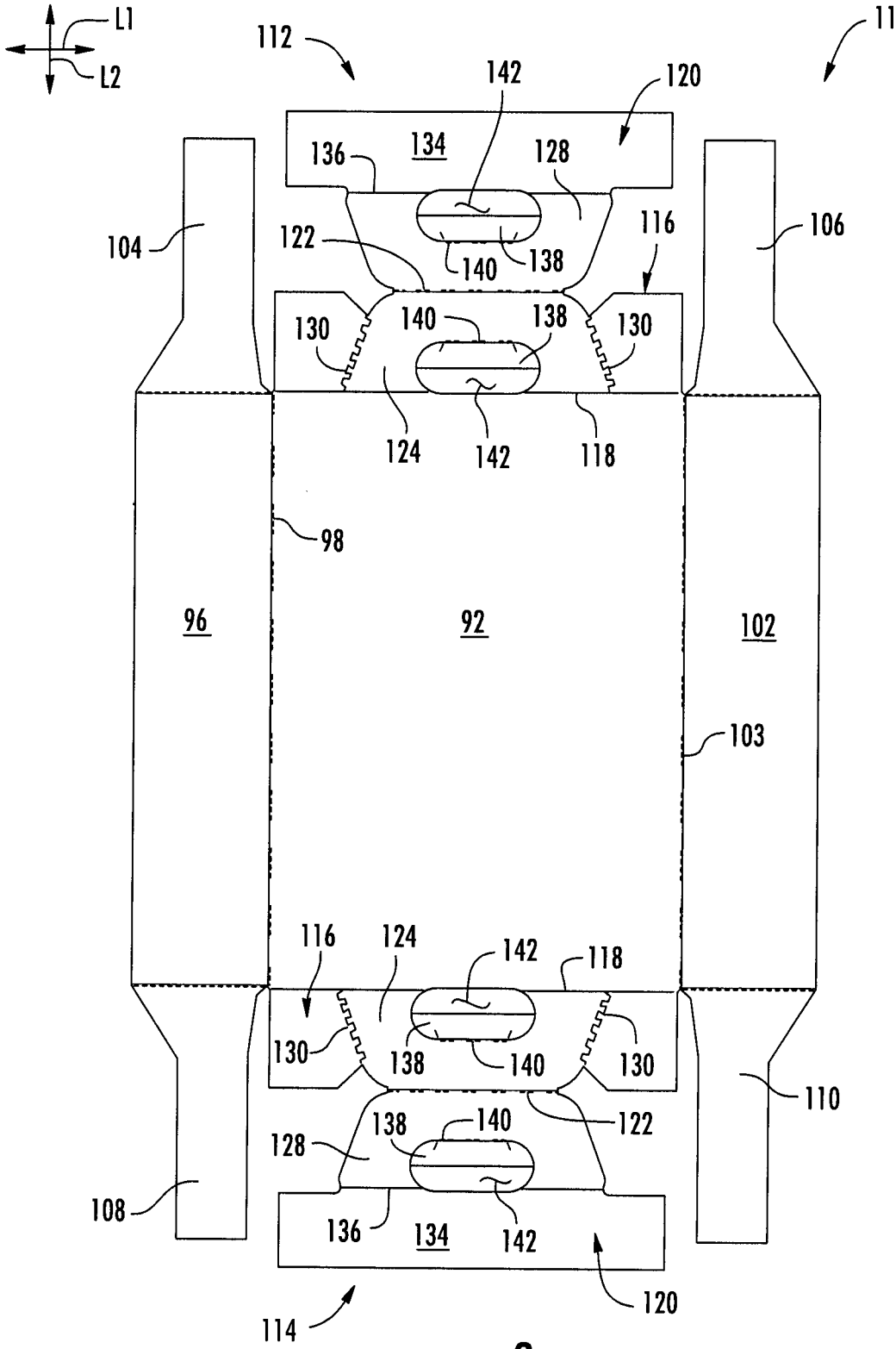
FIG. 2 is a plan view of a tray blank used to form a tray in the carton according to the exemplary embodiment of the disclosure.

FIG. 1 is a plan view of an exterior surface 2 of a carton blank 8 used to form a carton 150 (FIG. 5) according to an exemplary embodiment of the disclosure. The carton 150 can be used to house a plurality of articles such as containers C (FIG. 4) typically arranged in at least two layers in the carton. The layers of containers C are separated by a tray, generally indicated at 90 (FIG. 3) formed from a tray blank, generally indicated at 11 (FIG. 2). Accordingly, in one embodiment, the tray 90 forms a divider in the carton 150. In the illustrated embodiment, the containers C are arranged in a lower layer C1 and an upper layer C2 (FIG. 4) with each of the lower and upper layers C1, C2 comprising twelve containers arranged in three rows, four containers per row. This arrangement is generally referred to as a 3×4×2 arrangement. It is understood that the containers C may be arranged in more than two layers and that each layer may have more or less than twelve containers without departing from the scope of this disclosure. As will be discussed in more detail herein, in one embodiment, the tray 90 supports the upper layer C2 of containers C and can be removed from the carton 150 after activation of opening features of the carton.

The carton blank 8 has a longitudinal axis L1 and a lateral axis L2. In the illustrated embodiment, the carton blank 8 comprises a top panel 10 foldably connected to a first side panel 20 at a first transverse fold line 21, a first side panel 30 foldably connected to the top panel 10 at a second transverse fold line 31, and a bottom panel 40 foldably connected to the second side panel 30 at a third transverse fold line 41. An adhesive flap 50 can be foldably connected to the bottom panel 40 at a fourth transverse fold line 51.

The top panel 10 is foldably connected to a first top end flap 12 and a second top end flap 14. The first side panel 20 is foldably connected to a first side end flap 22 and a second side end flap 24. The second side panel 30 is foldably connected to a first side end flap 32 and a second side end flap 34. The bottom panel 40 is foldably connected to a first bottom end flap 42 and a second bottom end flap 44. When the carton 150 is erected, the end flaps 12, 22, 32, and 42 close a first end 53 of the carton 150, and the end flaps 14, 24, 34, and 44 close a second end 55 of the carton 150. In accordance with an alternative embodiment of the present disclosure, different flap arrangements can be used for closing the ends of the carton.

The end flaps 12, 22, 32, and 42 may extend along a first marginal area of the carton blank 8, and may be foldably connected at a first longitudinal fold line 62 that extends along the length of the carton blank 8. The end flaps 14, 24, 34, and 44 may extend along a second marginal area of the carton blank 8, and may be foldably connected at a second longitudinal fold line 64 that also extends along the length of the carton blank 8. The longitudinal fold lines 62, 64 may be, for example, substantially straight, or offset at one or more locations to account for blank thickness or for other factors.

The carton blank 8 has opening features that include a first tear strip 72 extending in the lateral direction L2 from an edge of the blank at the side end flap 22, across the first side panel 20, and across the second side end flap 24 to an edge of the blank. The opening features of the carton blank 8 include a second tear strip 74 extending in the lateral direction L2 from an edge of the blank at the side end flap 32, across the second side panel 30, and across the second side end flap 34 to an edge of the blank. In one embodiment, each of the tear strips 72, 74 is at least partially defined by two spaced, generally parallel tear lines 75 extending generally in the lateral direction L2. In the illustrated embodiment, the side end flaps 22, 24, 32, 34 have a respective notch 76 at a corresponding edge of the blank where the tear strip 72, 74 is located. The tear strips 72, 74 can include one or more opening tabs 78 extending adjacent one or more of the notches 76. As shown in FIG.

1, the opening tabs 78 are foldably connected to the tear strips 72, 74 along respective curved scores 80 so that a user can easily grasp one or more opening tabs 78 and initiate tearing of the tear strips 72, 74 from one or both ends 53, 55 of the erected carton 150. The side end flaps 22, 24, 32, 34 and/or the tear strips 72, 74 could be otherwise shaped, arranged, and/or configured without departing from the disclosure.

Figure 4:
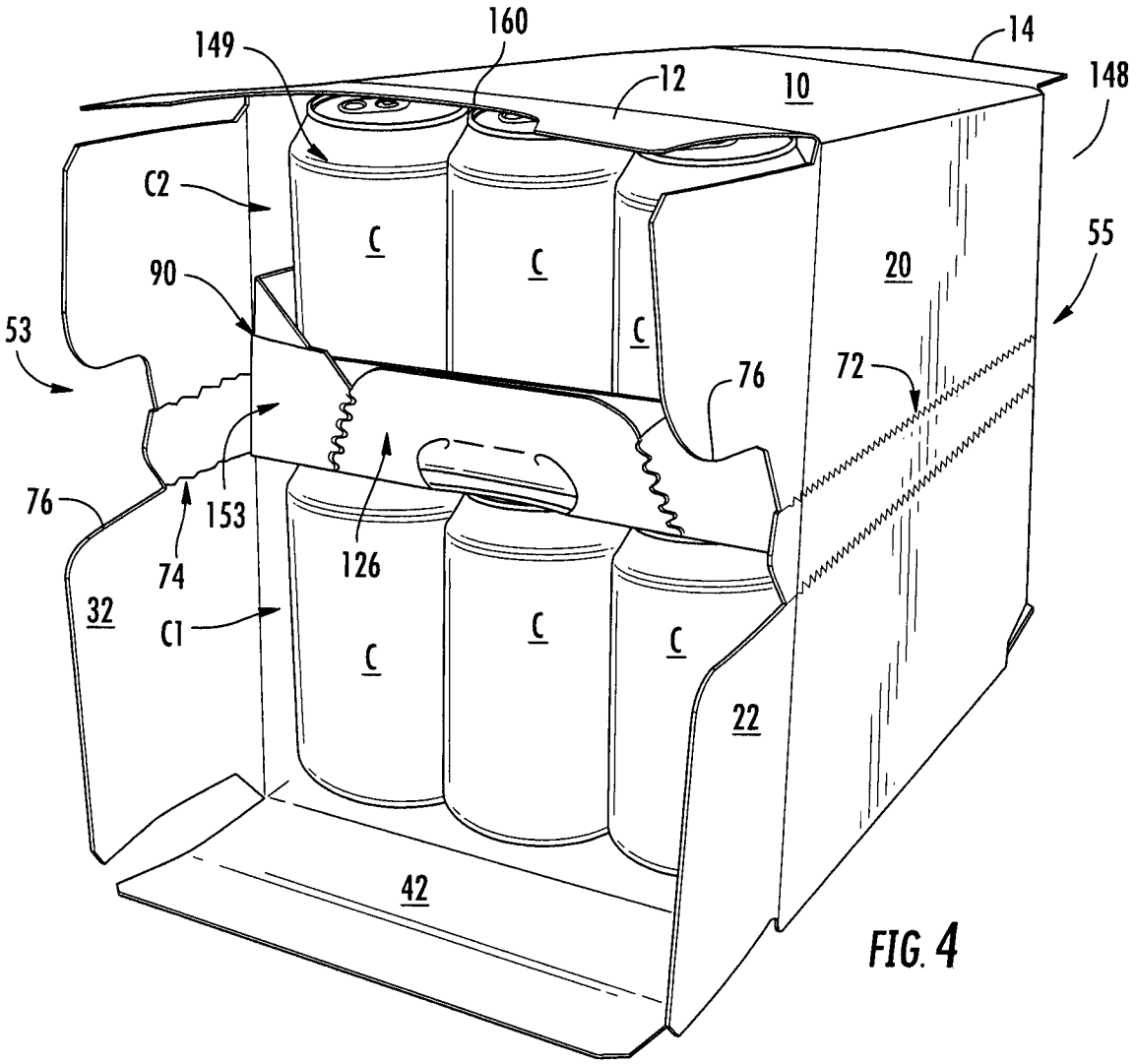
FIG. 4 is a perspective view showing the tray and a partially-erected carton according to the exemplary embodiment of the disclosure.
Figure 5:
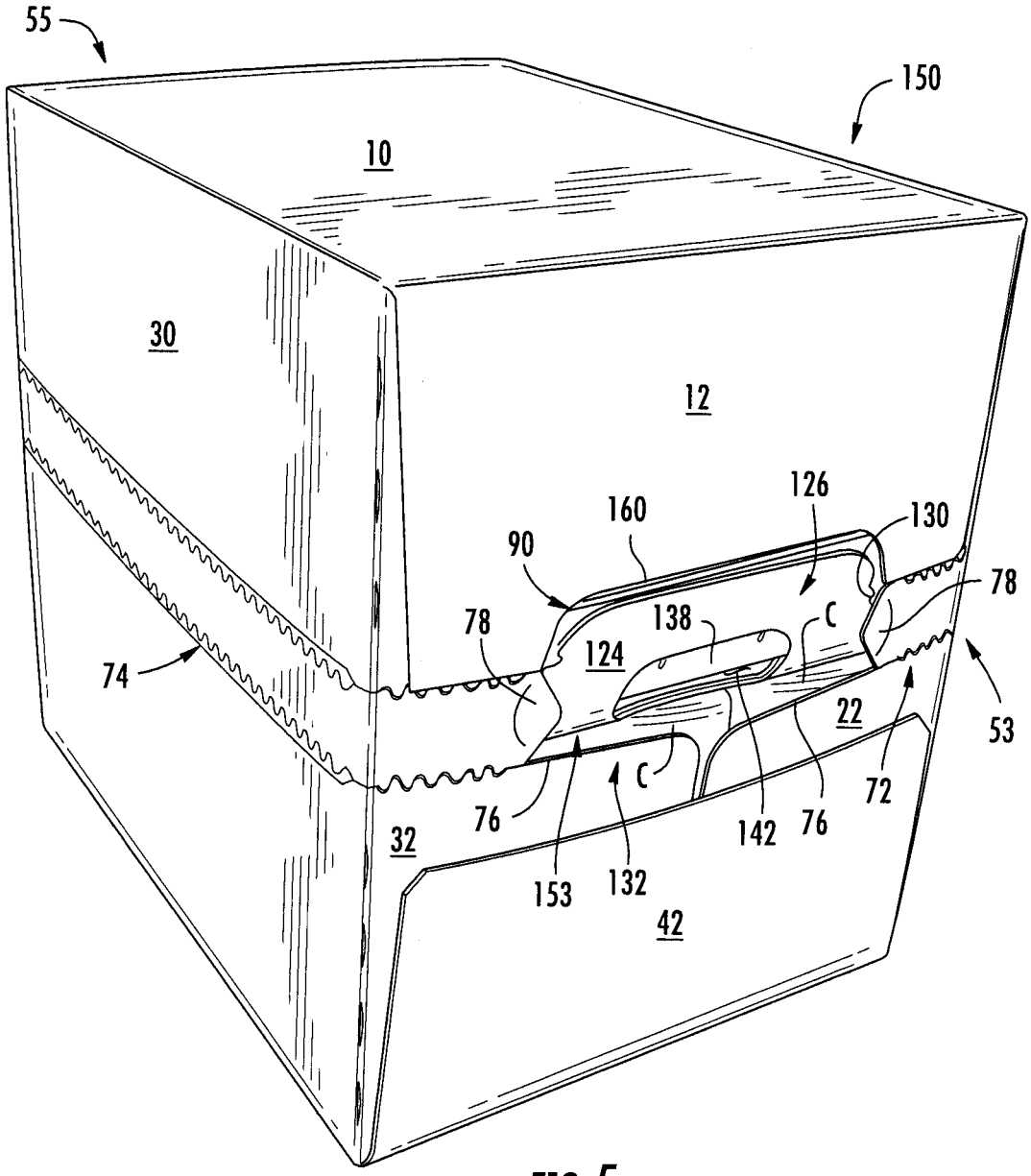
FIG. 5 is a perspective view showing the assembled carton and tray according to the exemplary embodiment of the disclosure.

As shown in FIG. 2, the tray blank 11 used to form the tray 90 of the illustrated embodiment has a longitudinal axis L1 and a lateral axis L2. As illustrated in FIG. 2, the L1 direction will be referred to as the longitudinal direction and the L2 direction will be referred to as the transverse or lateral direction for the tray blank 11 in order to comport with the convention established for the carton blank 8 (FIG. 1). Accordingly, a longitudinal line in the erected tray 90 will be generally aligned with and/or parallel to a longitudinal line (e.g., the longitudinal fold line 62) in the carton 150 when the tray 90 is disposed in the erected carton (FIG. 5). The tray blank 11 has a main panel 92 for positioning between the layers C1, C2 of containers C when the containers are loaded into the carton 150 (FIG. 4). The main panel 92 may be sized to generally correspond with the size of the top panel 10 and bottom panel 40 of the carton blank 8. The tray blank 11 includes a first side panel 96, foldably connected to the main panel 92 along a lateral fold line 98 and a second side panel 102 foldably connected to the main panel at a lateral fold line 103. Each of the side panels 96, 102 includes respective first reinforcing end flaps 104, 106 and respective second reinforcing end flaps 108, 110.

Figure 3:
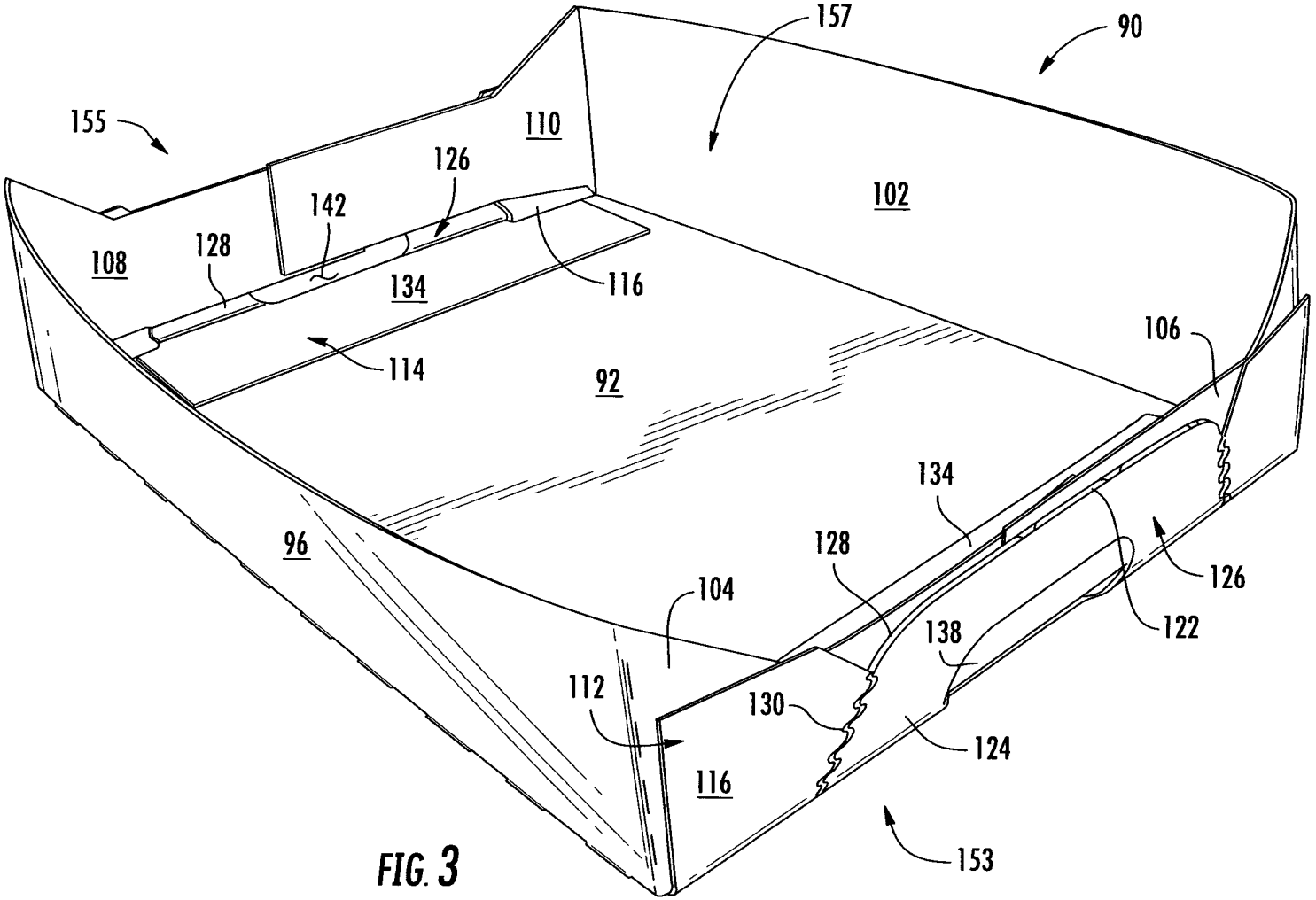
FIG. 3 is a perspective view showing the assembled tray according to the exemplary embodiment of the disclosure.

In the illustrated embodiment, the tray blank 11 includes a first end flap 112 and a second end flap 114. As shown in FIG. 2, each of the end flaps 112, 114 comprises a first portion 116 foldably connected to the main panel 92 at a respective lateral fold line 118 and a second portion 120 foldably connected to the first portion at a respective lateral fold line 122. In the illustrated embodiment, the end flaps 112, 114 are identical; however, either or both of the end flaps could be alternatively shaped, arranged, and/or configured, or omitted, without departing from the disclosure. When the tray 90 is erected, the reinforcing end flaps 104, 106 and the end flap 112 at least partially form a first end wall 153 of the tray 90, and the reinforcing end flaps 108, 110 and the end flap 114 at least partially form a second end wall 155 of the tray 90 (FIG. 3). The side panels 96, 102, the reinforcing end flaps 104, 106, 108, 110, and the end flaps 112, 114 could be otherwise shaped, arranged, and/or configured without departing from the disclosure. One or more of the side panels 96, 102, the reinforcing end flaps 104, 106, 108, 110, and the end flaps 112, 114 could be omitted without departing from the disclosure.

As shown in FIG. 2, each of the end flaps 112, 114 can include features for forming a handle 126 (FIG. 3) at a respective end of the tray 90 formed from the tray blank. In the illustrated embodiment, the handle features in each of the end flaps 112, 114 include a first handle panel 124 foldably connected to a second handle panel 128 along the respective lateral fold line 122. In one embodiment, each of the first handle panels 124 is foldably connected to the main panel 92 along the respective lateral fold line 118 and is partially defined by respective tear lines 130 extending obliquely in the respective first portions 116 of the end flaps 112, 114. In each of the second portions 120 of the respective end flaps 112, 114, the second handle panels 128 can be foldably connected to a respective attachment flap 134 along a respective lateral fold line 136. In the illustrated embodiment, the handle features include a handle flap 138 foldably connected to each of the handle panels 124, 128 along a respective lateral fold line 140 adjacent a respective handle opening 142. The features for forming the handles 126 could be omitted or otherwise shaped, arranged, and/or configured without departing from the disclosure.

In one embodiment, the tray 90 is formed from the tray blank 11 by upwardly folding the side panels 96, 102 and the first portions 116 of the end flaps 112, 114 relative to the main panel 92. As shown in FIG. 3, for each of the end flaps 112, 114, the second portions 120 of the end flaps 112, 114 can be folded along the respective lateral fold lines 122 so that the handle panels 124, 128 are in face-to-face contact and the attachment flap 134 is in face-to-face contact with the main panel 92. The attachment flaps 134 can be glued to the main panel 92 and/or the handle panels 124 can be glued to the respective handle panels 128.

In the illustrated embodiment, the reinforcing end flaps 104, 106, 108, 110 are folded relative to the side panels 96, 102 and adhered to the first portions 116 of the respective end flaps 112, 114. In one embodiment, the reinforcing end flaps 104, 106, 108, 110 are glued to the portions of the first portions 116 that are outside the tear lines 130 and are not glued to the handle panels 124, 128. Additionally, the reinforcing end flaps 104, 108 can at least partially overlap the respective reinforcing end flaps 106, 110 (FIGS. 3 and 6B), and the overlapping portions can be glued together. As shown in FIG. 3, the handle panels 128 at each end is in face-to-face contact with an interior surface of the respective handle panel 124 and an exterior surface of the reinforcing end flaps 104, 106 or 108, 110. In one embodiment, the reinforcing end flaps 104, 106 and the end flap 112 form a first end wall 153 of the tray 90, the reinforcing end flaps 108, 110 and the end flap 114 form a second end wall 155 of the tray 90, and the four sides of the tray 90 are formed by the upwardly folded side panels 96, 102 and end walls 153, 155 extending around an interior 157 of the tray (FIG. 3).

In one embodiment, the carton 150 may be erected from the carton blank 8 by first gluing or otherwise adhering the adhesive flap 50 to the inner side of the side panel 20 so that the top panel 10, the first side panel 20, the second side panel 30, and the bottom panel 40 may be opened or set up to form a generally tubular, open-ended sleeve 148 having an interior 149 (FIG. 4). The tray 90 and/or the open-ended sleeve 148 could be formed by other folding, positioning, and/or gluing steps without departing from the disclosure.

As shown in FIG. 4, the containers C can be configured in a stacked arrangement with a first (lower) layer of containers C1 and a second (upper) layer of containers C2 located above the first layer of containers C1. The tray 90 can be positioned between the two layers of containers prior to placing the containers in the open-ended sleeve 148. In one embodiment, the second (upper) layer of containers C2 is placed on the main panel 92 of the tray 90 and the containers are supported by the side panels 96, 102 and end walls 153, 155, and the main panel 92 can act as a divider separating the first and second layers of containers C1, C2.

Figure 6A:
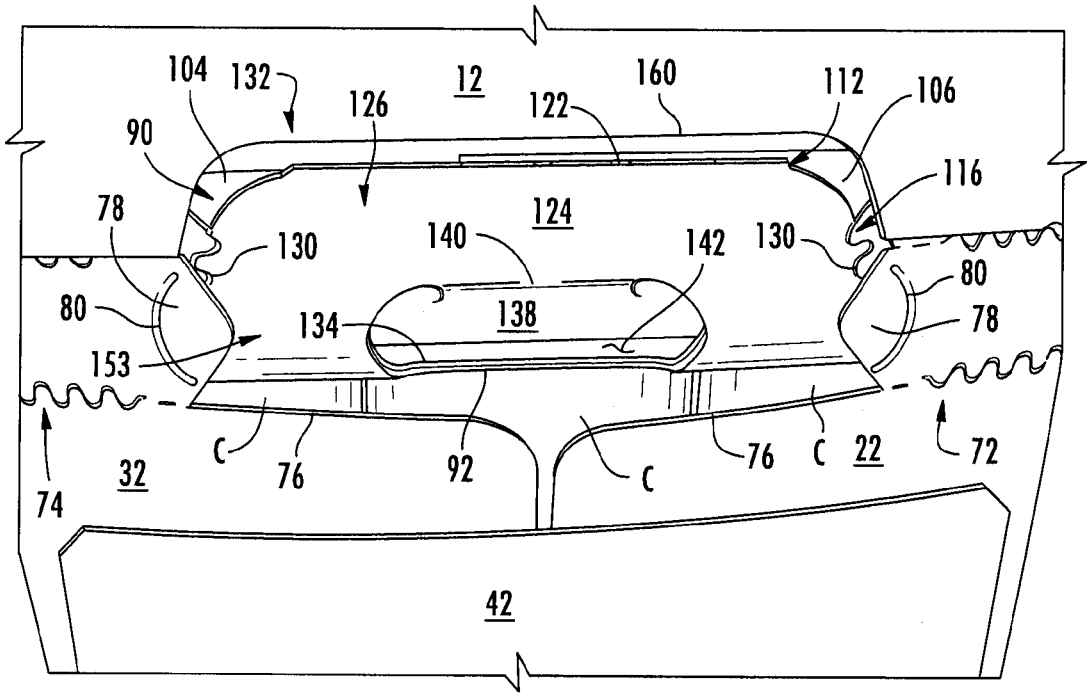
FIGS. 6A and 6B are perspective views of an end of the carton of FIG. 5 showing a handle of the tray according to the exemplary embodiment of the disclosure.
Figure 7:
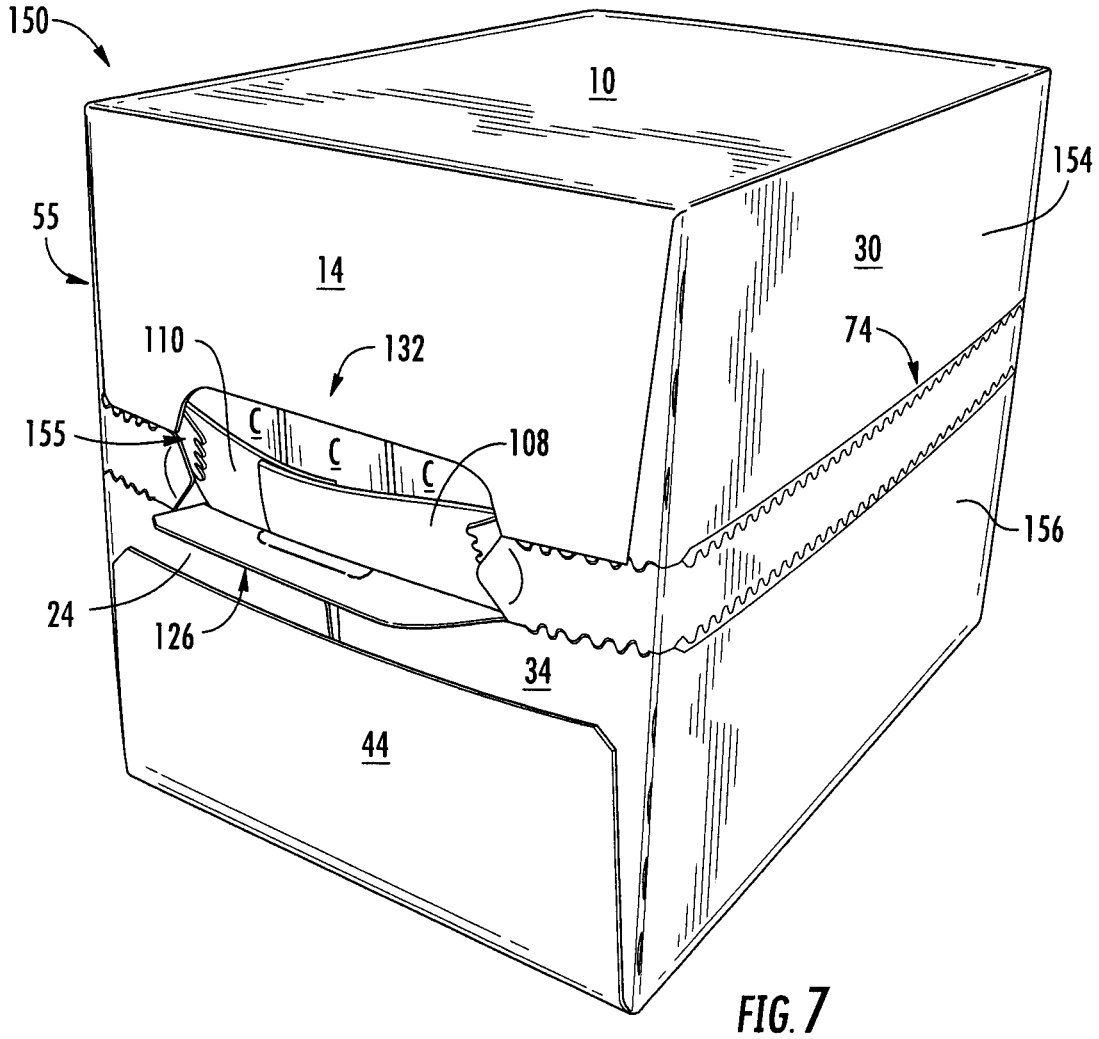
FIG. 7 is a perspective view of the carton of FIG. 5 with the activated handle of FIG. 6B according to the exemplary embodiment of the disclosure.

The containers C arranged in the two layers C1, C2 with the tray 90 therebetween can be loaded into the interior 149 of the partially erected carton or sleeve 148 (FIG. 4), and the ends 53, 55 can be closed. The generally tubular sleeve may be closed, for example, by folding and adhering the end flaps 12, 22, 32, 42 at one end 53 of the carton 150, and by folding and adhering the end flaps 14, 24, 34, 44 at the other end 55 of the carton. As shown in FIGS. 5 and 6A, the notches 76 in the side end flaps 22, 32 are aligned with a notch 160 in the top end flap 12 so that an opening 132 is formed in the first closed end 53. Similarly, as shown in FIG. 7, the notches 76 in the side end flaps 24, 34 are aligned with a notch 160 in the top end flap 114 to form an opening 132 in the closed end 55. Containers C or other articles and/or the tray 90, for example, may be loaded into the sleeve at any time before one or both ends 53, 55 of the carton 150 are closed by the end flaps 12, 22, 32, 42, 14, 24, 34, 44. The carton 150 could be formed by other folding, positioning, and/or gluing steps without departing from the disclosure.

Figure 6B:
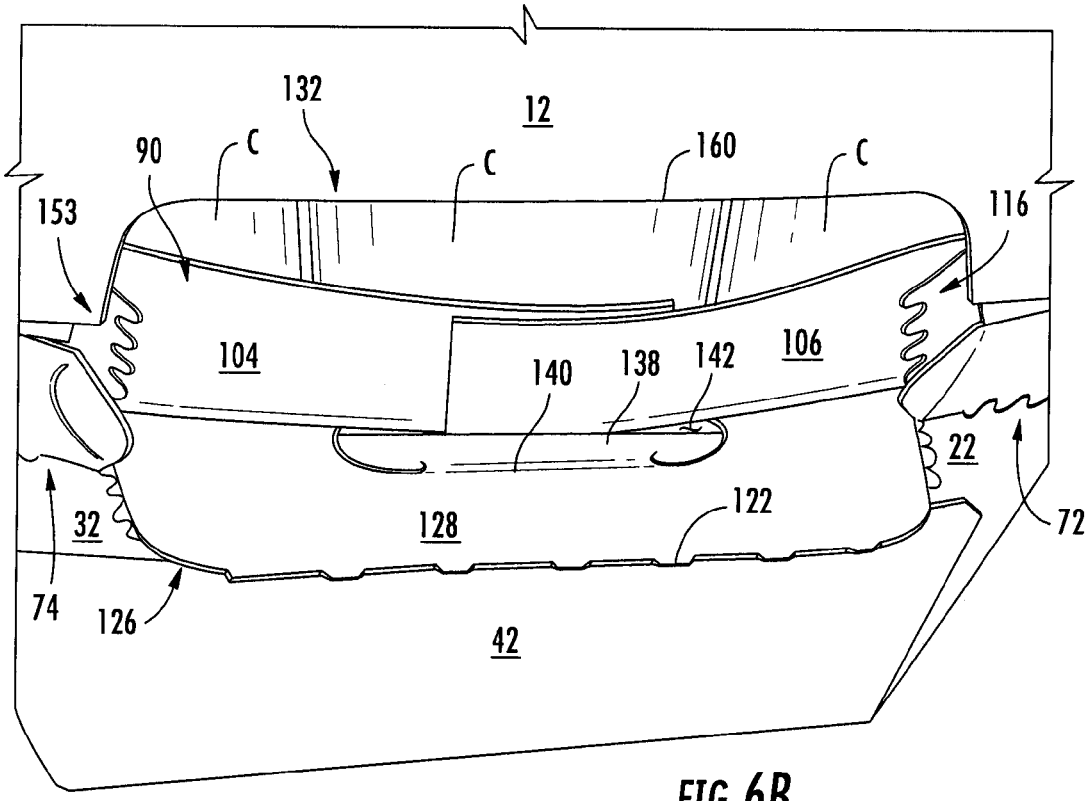

As shown in FIGS. 6A and 6B, the handles 126 of the tray 90 can be activated at each closed end 53, 55 of the carton 150 through the openings 132. In one embodiment, one or both of the handles 126 can be grasped at the respective handle openings 142 and pulled outwardly through the openings 132 from the interior 149 of the carton 150. Accordingly, in each of the handles 126, the first handle panel 124 can tear away from the first portion 116 along the tear lines 130, and the handle panels 124, 128 can pivot outwardly with respect to the main panel 92 along the respective lateral fold line 118. The carton 150 and tray 90 with an activated handle 126 is shown in FIG. 7. In one embodiment, lifting the tray 90 by the handles 126 while in the closed carton 150 will lift the tray 90, the carton 150, and the containers C in both layers C1, C2 since the tray is enclosed by the carton. The carton 150 and/or tray 90 could be otherwise carried without departing from the disclosure.

Figure 8:
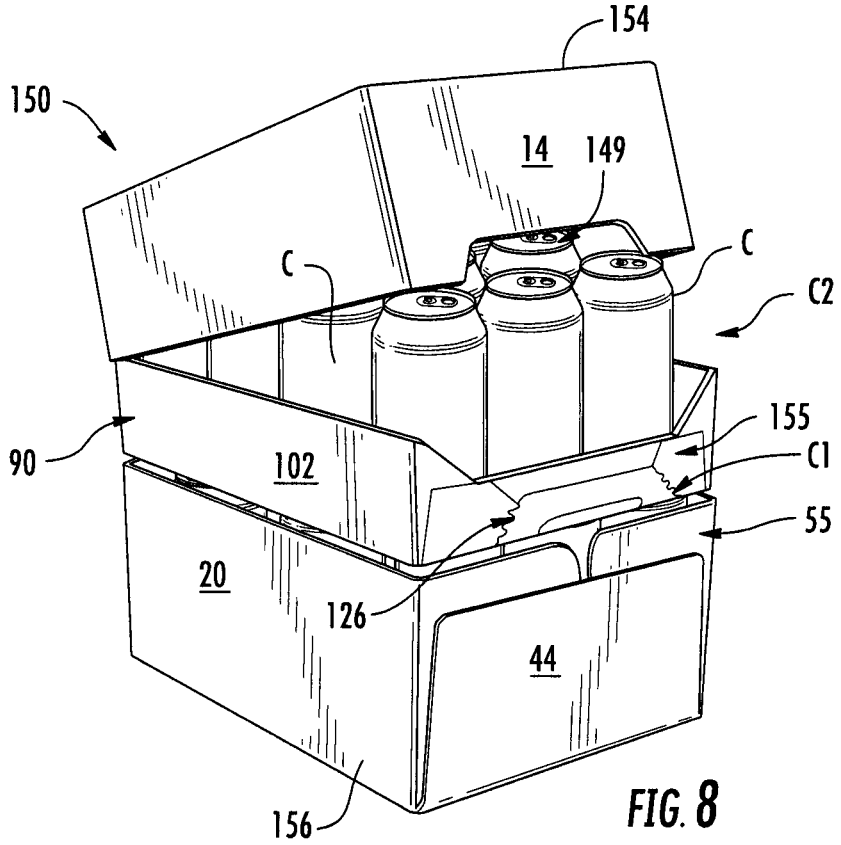
FIG. 8 is a perspective view showing the partially opened carton according to the exemplary embodiment of the disclosure.
Figure 9:
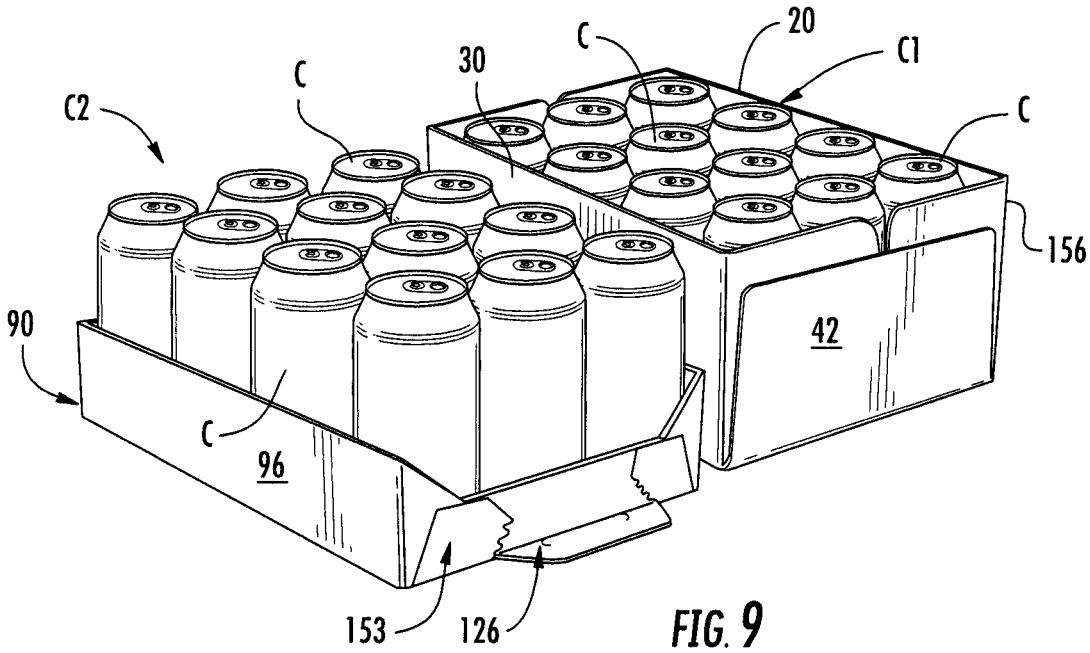
FIG. 9 is a perspective view showing a lower portion of the carton and the removed tray according to the exemplary embodiment of the disclosure.

As shown in FIGS. 8 and 9, the carton 150 can be opened by activating the opening features or tear strips 72, 74 to separate the carton 150 into an upper portion 154 and a lower portion 156 (FIGS. 7 and 8). Removal of the upper portion 154 of the carton 150 provides access to the containers C in the upper layer C2 that are located in the tray 90. In one embodiment, the tear strips 72, 74 are generally aligned with the side panels 96, 102 of the tray 90 so that the tray is at least partially exposed when the top portion 154 and the tear strips 72, 74 are removed. The tray 90 with the upper layer of containers C2, can be lifted and carried at the handles 126 to remove the tray 90 and the upper layer of containers C2 from the lower portion 156 of the carton 150 (FIG. 9). In one embodiment, half of the containers C are located in the upper layer C2 that can be carried by the tray 90 and half of the containers C are located in the lower layer C1 that can be carried by the lower portion 156 of the carton 150. Additionally, removing the tray 90 with the upper layer of containers C2 provides access to the containers C in the lower layer C1 in the lower portion 156. Alternatively, the containers C and/or the tray 90 could be otherwise removed from the carton 150.

In the illustrated embodiment, the carton 150 has three components for holding and carrying the containers C in the form of the upper portion 154, the lower portion 156 that is removably attached to the upper portion 154 by the tear features 72, 74, and the tray 90. The carton 150 could have other features or the features shown could be otherwise shaped, arranged, and/or configured without departing from the disclosure. For example, while the containers C are depicted in the figures as cans, the carton 150 and the tray 90 can be configured to contain any suitable beverage container or other article.

The present disclosure can be used in cartons that include various features, including additional opening features that provide easy access to the articles, and tilt features that position the articles at the front or rear end of the carton.

In general, the blanks of the present disclosure may be constructed from paperboard having a caliper so that it is heavier and more rigid than ordinary paper. The blank can also be constructed of other materials, such as cardboard, or any other material having properties suitable for enabling the carton to function at least generally, as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding there along. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments. Additionally, the disclosure shows and describes only selected embodiments, but various other combinations, modifications, and environments are within the scope of the disclosure as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for containing a plurality of articles arranged in at least a first layer and a second layer above the first layer, the carton comprising:

a plurality of panels that extends at least partially around an interior of the carton, the plurality of panels comprises a side panel;

a plurality of end flaps respectively foldably connected to respective panels of the plurality of panels, the plurality of end flaps being overlapped with respect to one another to thereby at least partially form a closed end of the carton, the plurality of end flaps comprises a side end flap foldably connected to the side panel;

an opening feature for accessing the articles in the carton, the opening feature extending in at least the side end flap and the side panel; and a tray disposed at least partially in the interior of the carton, at least a portion of the tray being for positioning between the first layer and the second layer, the tray being for supporting the articles in the second layer to allow removal of the articles in the second layer after activation of the opening feature of the carton.

2. The carton of claim 1, wherein the tray comprises a main panel and an end flap foldably connected to the main panel, the main panel is for being positioned between the at least two layers, and the end flap comprises a handle.

3. The carton of claim 2, wherein the handle is foldably connected to the main panel and comprises a handle opening.

4. The carton of claim 2, wherein the end flap comprises a first end flap portion and a second end flap portion, the first end flap portion comprising a first handle panel and the second end flap portion comprising a second handle panel, the first handle panel being foldably connected to the main panel and the second handle panel being foldably connected to the first handle panel.

5. The carton of claim 4, wherein the second end flap portion comprises an attachment flap foldably connected to the second handle panel, the second handle panel is at least partially in face-to-face contact with the first handle panel, and the attachment flap at least partially overlaps the main panel.

6. The carton of claim 5, wherein the first handle panel is at least partially defined by a tear line extending in the first end flap portion.

7. The carton of claim 5, wherein the tray further comprises a side panel foldably connected to the main panel and a reinforcing end flap foldably connected to the side panel, the reinforcing end flap being at least partially in face-to-face contact with at least a portion of the first end flap portion.

8. The carton of claim 7, wherein the reinforcing end flap is at least partially in face-to-face contact with the second handle panel.

9. The carton of claim 2, wherein:

the end flap of the tray is a first end flap and the handle is a first handle; and the tray further comprises a second end flap foldably connected to the main panel, the second end flap comprising a second handle.

10. The carton of claim 9, wherein the tray further comprises a first side panel and a second side panel, each of the first side panel and the second side panel being respectively foldably connected to the main panel and comprising a respective first reinforcing end flap and a respective second reinforcing end flap, the first reinforcing end flaps being at least partially overlapped adjacent the first end flap and the second reinforcing end flaps being at least partially overlapped adjacent the second end flap.

11. The carton of claim 1, further comprising:

an opening extending in the closed end of the carton.

12. The carton of claim 11, wherein:

the opening comprises a notch in the side end flap; and the opening feature comprises a tear strip extending in at least the side end flap and the side panel, the tear strip extending from the notch.

13. The carton of claim 12, wherein:

the side panel is a first side panel, the side end flap is a first side end flap, the notch is a first notch, and the tear strip is a first tear strip;

the plurality of panels comprises a second side panel;

the plurality of end flaps comprises a second side end flap foldably connected to the second side panel;

the opening comprises a second notch in the second side end flap; and the opening feature comprises a second tear strip extending in at least the second side end flap and the second side panel, the second tear strip extending from the second notch.

14. The carton of claim 11, wherein the tray comprises a handle that is generally aligned with the opening.

15. The carton of claim 14, wherein:

the tray further comprises a main panel; and the handle comprises a handle panel foldably connected to the main panel and a handle opening extending between the handle panel and the main panel.

16. In combination, a carton blank and a tray blank for forming a carton for containing a plurality of articles arranged in at least a first layer and a second layer above the first layer, the carton blank comprising a plurality of panels for at least partially extending around an interior of the carton formed from the blank and an opening feature extending in at least one panel of the plurality of panels, and a plurality of end flaps respectively foldably connected to respective panels of the plurality of panels, the plurality of end flaps for being overlapped with respect to one another to thereby at least partially form a closed end of the carton formed from the carton blank; and the tray blank comprising at least a main panel for at least partially forming a tray disposed at least partially in the interior of the carton formed from the carton blank, at least a portion of the main panel being for positioning between the first layer and the second layer, wherein when the carton is formed, the tray is for supporting the articles in the second layer to allow removal of the articles in the second layer after activation of the opening feature of the carton formed from the carton blank; and features for forming an opening extending in the closed end of the carton formed from the carton blank.

17. The combination of claim 16, wherein the tray blank comprises an end flap foldably connected to the main panel, the main panel is for being positioned between the at least two layers, and the end flap comprises handle features for forming a handle in the tray formed from the tray blank.

18. The combination of claim 17, wherein the end flap comprises a first end flap portion and a second end flap portion, the first end flap portion comprising a first handle panel and the second end flap portion comprising a second handle panel, the first handle panel being foldably connected to the main panel and the second handle panel being foldably connected to the first handle panel.

19. The combination of claim 18, wherein the second end flap portion comprises an attachment flap foldably connected to the second handle panel, and the second handle panel is for being disposed at least partially in face-to-face contact with the first handle panel and the attachment flap is for at least partially overlapping the main panel when the tray is formed from the tray blank.

20. The combination of claim 19, wherein the first handle panel is at least partially defined by a tear line extending in the first end flap portion.

21. The combination of claim 19, wherein the tray further comprises a side panel foldably connected to the main panel and a reinforcing end flap foldably connected to the side panel, the reinforcing end flap for being positioned at least partially in face-to-face contact with at least a portion of the first end flap portion when the tray is formed from the tray blank.

22. The combination of claim 21, wherein the reinforcing end flap is for being disposed at least partially in face-to-face contact with the second handle panel when the tray is formed for the tray blank.

23. The combination of claim 17, wherein:

the end flap of the tray blank is a first end flap and the handle features are first handle features for forming a first handle in the tray formed from the tray blank;

the tray blank further comprises a second end flap, a first side panel, and a second side panel, each of the second end flap, the first side panel, and the second side panel being respectively foldably connected to the main panel;

the second end flap comprises second handle features for forming a second handle in the tray formed from the tray blank;

each of the first side panel and the second side panel comprises a respective first reinforcing end flap and a respective second reinforcing end flap; and the first reinforcing end flaps are for being at least partially overlapped adjacent the first end flap and the second reinforcing end flaps are for being at least partially overlapped adjacent the second end flap when the tray is formed from the tray blank.

24. The combination of claim 16, wherein:

the plurality of panels comprises a side panel;

the plurality of end flaps comprises a side end flap foldably connected to the side panel;

the features for forming the opening comprise a notch in the side end flap; and the opening feature comprises a tear strip extending in at least the side end flap and the side panel, the tear strip extending from the notch.

25. The combination of claim 24, wherein:

the side panel is a first side panel, the side end flap is a first side end flap, the notch is a first notch, and the tear strip is a first tear strip;

the plurality of panels comprises a second side panel;

the plurality of end flaps comprises a second side end flap foldably connected to the second side panel;

the features for forming the opening comprise a second notch in the second side end flap; and the opening feature comprises a second tear strip extending in at least the second side end flap and the second side panel, the second tear strip extending from the second notch.

26. The combination of claim 16, wherein the tray blank comprises handle features for forming a handle that is for being generally aligned with the opening extending in the closed end of the carton formed from the carton blank.

27. The combination of claim 26, wherein the handle features comprise a handle panel foldably connected to the main panel and a handle opening extending between the handle panel and the main panel.

28. A method of forming a carton, comprising:

obtaining a carton blank and a tray blank, the carton blank comprising a plurality of panels and a plurality of end flaps respectively foldably connected to respective panels of the plurality of panels, the plurality of panels comprises a side panel, the plurality of end flaps comprises a side end flap foldably connected to the side panel, and the carton blank further comprising an opening feature extending in at least the side end flap and the side panel, and the tray blank comprising at least a main panel;

forming an interior of the carton at least partially defined by the plurality of panels, the forming the interior of the carton comprising forming an open-ended sleeve;

forming a tray from the tray blank;

arranging a plurality of containers in at least a first layer and a second layer so that at least a portion of the main panel of the tray is disposed between the first layer and the second layer; and inserting the plurality of containers and the tray at least partially into the interior of the carton, wherein the tray supports the articles in the second layer to allow removal of the articles in the second layer after activation of the opening feature of the carton.

29. The method of claim 28, wherein the tray blank comprises an end flap foldably connected to the main panel, the main panel is for being positioned between the at least two layers, and the forming the tray further comprises forming a handle in the end flap.

30. The method of claim 29, wherein the end flap comprises a first end flap portion and a second end flap portion, the first end flap portion comprising a first handle panel and the second end flap portion comprising a second handle panel, the first handle panel being foldably connected to the main panel and the second handle panel being foldably connected to the first handle panel, the forming the handle comprising folding the second handle panel to overlap the first handle panel.

31. The method of claim 30, wherein the second end flap portion comprises an attachment flap foldably connected to the second handle panel, the forming the tray comprising positioning the attachment flap to at least partially overlap the main panel.

32. The method of claim 31, wherein the tray further comprises a side panel foldably connected to the main panel and a reinforcing end flap foldably connected to the side panel, the forming the tray comprising positioning the reinforcing end flap to be at least partially in face-to-face contact with at least a portion of the first end flap portion.

33. The method of claim 28, further comprising:

a plurality of end flaps respectively foldably connected to respective panels of the plurality of panels, the forming the carton comprising at least partially forming a closed end of the carton by overlapping the plurality of end flaps with respect to one another;

the at least partially forming the closed end comprises forming an opening extending in the closed end of the carton; and the tray comprises a handle that is generally aligned with the opening.

34. A method of opening a carton, comprising:

obtaining a carton comprising a plurality of panels that extends at least partially around an interior of the carton, an opening feature extending in at least one panel of the plurality of panels, and a tray disposed at least partially in the interior of the carton, wherein the carton contains a plurality of articles arranged in at least a first layer and a second layer above the first layer, and at least a portion of the tray is disposed between the first layer and the second layer, the tray at least partially containing the articles in the second layer, and the plurality of panels comprises a side panel, the carton further comprising a plurality of end flaps respectively foldably connected to respective panels of the plurality of panels, the plurality of end flaps being overlapped with respect to one another to thereby at least partially form a closed end of the carton, the plurality of end flaps comprises a side end flap foldably connected to the side panel;

at least partially opening the carton by actuating the opening feature extending in at least the side end flap and the side panel to at least partially separate an upper portion and a lower portion of the carton and at least partially removing the upper portion; and removing the tray and the second layer of articles from the lower portion of the carton.

35. The method of claim 34, wherein the tray comprises a main panel and an end flap foldably connected to the main panel, the main panel being disposed between the at least two layers, the end flap comprising a handle, and the removing the tray and the second layer of articles comprises grasping the handle to carry the tray.

36. The method of claim 34, wherein:

the carton further comprises an opening extending in the closed end of the carton;

the opening feature comprises a tear strip extending in at least one panel of the plurality of panels and at least one end flap of the plurality of end flaps, the tear strip extending from the opening; and the at least partially opening the carton comprising tearing the tear strip from the opening.

37. The method of claim 36, wherein:

the opening comprises a notch in the side end flap; and the tear strip extends in at least the side end flap and the side panel.

38. The method of claim 37, wherein:

the side panel is a first side panel, the side end flap is a first side end flap, the notch is a first notch, and the tear strip is a first tear strip;

the plurality of panels comprises a second side panel;

the plurality of end flaps comprises a second side end flap foldably connected to the second side panel;

the opening comprises a second notch in the second side end flap;

the opening feature comprises a second tear strip extending in at least the second side end flap and the second side panel, the second tear strip extending from the second opening; and the at least partially opening the carton comprising at least partially removing the first tear strip and the second tear strip by tearing the first tear strip and the second tear strip from the opening.

39. The method of claim 36, wherein the tray comprises a handle that is generally aligned with the opening.

40. A method of forming a handle in a carton, comprising:

obtaining a carton comprising a plurality of panels that extends at least partially around an interior of the carton, an opening feature extending in at least one panel of the plurality of panels, and a tray disposed at least partially in the interior of the carton, the tray comprising a main panel and a handle foldably connected to the main panel, wherein the carton contains a plurality of articles arranged in at least a first layer and a second layer above the first layer, and at least a portion of the main panel is disposed between the first layer and the second layer;

grasping the handle of the tray;

folding the handle out from the interior of the carton;

actuating the opening feature to separate the carton into an upper portion and a lower portion;

at least partially removing the upper portion of the carton; and carrying the tray and the second layer of the plurality of articles at handle of the tray and removing the tray and the second layer of the plurality of articles from the lower portion of the carton.

41. The method of claim 40, wherein:

the carton further comprises a plurality of end flaps respectively foldably connected to respective panels of the plurality of panels, the plurality of end flaps being overlapped with respect to one another to thereby at least partially form a closed end of the carton, and an opening extending in the closed end of the carton;

the grasping the handle of the tray comprises reaching through the opening in the closed end of the carton; and the folding the handle comprises folding at least a portion of the handle through the opening.

42. The method of claim 40, wherein the tray comprises an end flap foldably connected to the main panel, at least a portion of the handle is connected to the end flap along a tear line, and the folding the handle comprises at least partially separating at least a portion of the handle from the end flap along the tear line.

43. The method of claim 40, wherein the handle is a first handle and the tray comprises a second handle foldably connected to the main panel, the method further comprising grasping the second handle of the tray and folding the second handle out from the interior of the carton.

44. A package comprising:

a carton containing a plurality of articles arranged in at least a first layer and a second layer above the first layer, the carton comprising:

a plurality of panels that extends at least partially around an interior of the carton, the plurality of panels comprises a side panel;

a plurality of end flaps respectively foldably connected to respective panels of the plurality of panels, the plurality of end flaps being overlapped with respect to one another to thereby at least partially form a closed end of the carton, the plurality of end flaps comprises a side end flap foldably connected to the side panel; and an opening feature for accessing the articles in the carton, the opening feature extending in at least the side end flap and the side panel; and a tray at least partially disposed in the carton, wherein at least a portion of the tray is positioned between the first layer and the second layer, the tray supporting the articles in the second layer when removing the articles in the second layer after activation of the opening feature of the carton.

45. The package of claim 44, further comprising:

an opening extending in the closed end of the carton.

46. The package of claim 45, wherein:

the opening comprises a notch in the side end flap; and the opening feature comprises a tear strip extending in at least the side end flap and the side panel, the tear strip extending from the notch.

47. The package of claim 45, wherein the tray comprises a handle that is generally aligned with the opening.

48. The package of claim 47, wherein:

the tray further comprises a main panel; and the handle comprises a handle panel foldably connected to the main panel and a handle opening extending between the handle panel and the main panel.

* * * * *